US010161703B2

(12) United States Patent
Xu

(10) Patent No.: US 10,161,703 B2
(45) Date of Patent: Dec. 25, 2018

(54) INTEGRATED STRUCTURE OF BARREL AND AIR STORAGE PIPE OF AIR GUN

(71) Applicant: Shaoxing Lingfeng Air Gun Manufacturing Co., Ltd., Shaoxing (CN)

(72) Inventor: Lihua Xu, Shaoxing (CN)

(73) Assignee: SHAOXING LINGFENG AIR GUN MANUFACTURING CO., LTD., Shaoxing, Zhejiang (CN)

( * ) Notice: Subject to any disclaimer, the term of this patent is extended or adjusted under 35 U.S.C. 154(b) by 0 days.

(21) Appl. No.: 15/682,498

(22) Filed: Aug. 21, 2017

(65) Prior Publication Data

US 2018/0245870 A1 Aug. 30, 2018

(30) Foreign Application Priority Data

Feb. 24, 2017 (CN) ..... 2017 1 0102392

(51) Int. Cl.
*F41A 21/28* (2006.01)
*F41A 21/48* (2006.01)

(52) U.S. Cl.
CPC ..... *F41A 21/28* (2013.01); *F41A 21/48* (2013.01)

(58) Field of Classification Search
CPC ..... F41A 21/28; F41A 21/48
USPC ..... 124/56
See application file for complete search history.

(56) References Cited

U.S. PATENT DOCUMENTS 2,916,970 A * 12/1959 Mutter ..... F41A 21/00 89/14.3
3,051,057 A * 8/1962 Ivy ..... F41A 19/52 42/59
9,915,496 B2 * 3/2018 Bergeron ..... F41B 11/68

* cited by examiner

*Primary Examiner* — Samir Abdosh
(74) *Attorney, Agent, or Firm* — Leong C. Lei

(57) ABSTRACT

An integrated structure of a barrel and an air storage pipe of an air gun is provided. The air storage pipe is fixedly connected with a first connecting member and a second connecting member. The barrel is fixedly connected between the first connecting member and the second connecting member. The air storage pipe, the first connecting member, the second connecting member and the barrel cooperate to form an air storage area. The air storage area is located between the first connecting member and the second connecting member and communicated with an inflation head through an air supply passage disposed in the second connecting member. The layout of the air storage pipe and the barrel is more reasonable to prolong the service life of the air gun and to enhance the shooting accuracy.

3 Claims, 2 Drawing Sheets

INTEGRATED STRUCTURE OF BARREL AND AIR STORAGE PIPE OF AIR GUN

BACKGROUND OF THE INVENTION

1. Field of the Invention

The present invention relates to an air gun, and more particularly to an integrated structure of a barrel and an air storage pipe of an air gun.

2. Description of the Prior Art

In the prior art, an air gun that provides air supply by a pneumatic force is formed with an air storage area in the gun body. When the air gun is fired, the air supply in the gas storage area enters the barrel through an air supply passage and provides the firing power for bullets in the barrel.

As shown in FIG. 1, a conventional air gun includes an air storage pipe A and a barrel B. The air storage pipe A and the barrel B are provided separately, and the air storage pipe A is located under the barrel B. The air storage pipe A is communicated with the barrel B through an air supply passage C. Because the air storage pipe A and the barrel B of this air gun are provided separately, the air gun is large in size and heavy in weight, which may affect the shooting accuracy. Furthermore, some air storage pips need to be replaced with a new one when the air supply is used up. After a period of time, the air storage pipe cannot be tightly fitted with the air supply passage, resulting in poor air tightness and air leakage. The layout of the air storage pipe and the barrel is unreasonable to impact on the service life of the air gun.

Accordingly, the inventor of the present invention has devoted himself based on his many years of practical experiences to solve these problems.

SUMMARY OF THE INVENTION

The primary object of the present invention is to provide an integrated structure of a barrel and an air storage pipe of an air gun, so that the layout of the air storage pipe and the barrel is more reasonable to prolong the service life of the air gun and to enhance the shooting accuracy.

In order to achieve the aforesaid object, an integrated structure of a barrel and an air storage pipe of an air gun is provided. The air storage pipe is fixedly connected with a first connecting member and a second connecting member. The barrel is fixedly connected between the first connecting member and the second connecting member. The air storage pipe, the first connecting member, the second connecting member and the barrel cooperate to form an air storage area. The air storage area is located between the first connecting member and the second connecting member and communicated with an inflation head through an air supply passage disposed in the second connecting member.

Preferably, the first connecting member has a first chamber therein. The second connecting member has a second chamber therein. The first connecting member and the second connecting member are threadedly connected to the air storage pipe. The barrel is fixed in the first chamber and the second chamber. The barrel is threadedly connected with the first connecting member and the second connecting member. The first chamber is in communication with air. A muzzle of the barrel is located in the first chamber.

Preferably, sealing rings are provided at the junction of the barrel and the first connecting member, the junction of the barrel and the second connecting member, the junction of the first connecting member and the air storage pipe, and the junction of the second connecting member and the air storage pipe, respectively.

Preferably, the inflation head includes an inflation seat fixed to the air gun. A sealing head is movably disposed in the inflation seat. One end of the sealing head is connected with a spring. The sealing head is biased by the spring to seal an inflation inlet.

The beneficial effects of the present invention are described hereinafter. The air storage pipe, the first connecting member, the second connecting member and the barrel cooperate to form the air storage area to realize the integral structure of the barrel and the air storage pipe. The layout of the air storage pipe and the barrel is more reasonable and beautiful. The air gun is compact in size and light in weight.

DETAILED DESCRIPTION OF THE PREFERRED EMBODIMENTS

Embodiments of the present invention will now be described, by way of example only, with reference to the accompanying drawings.

Figure 1:
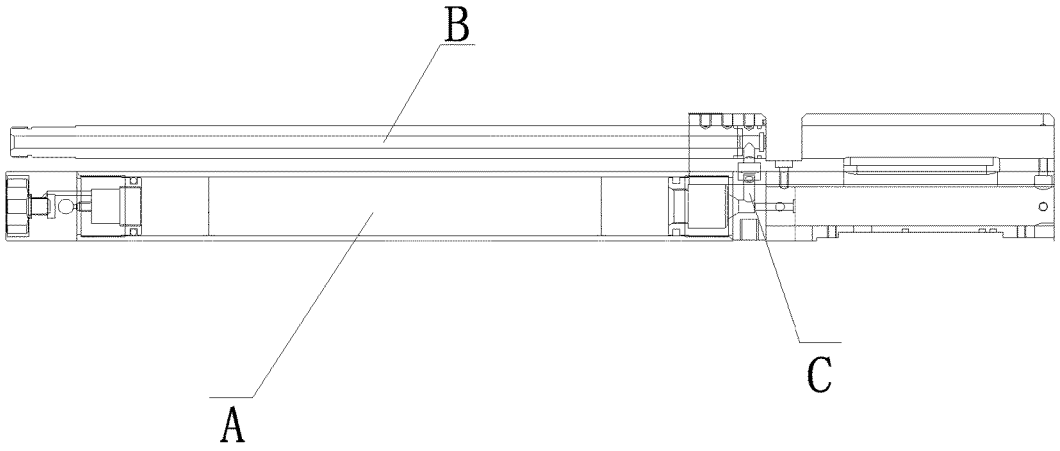
F I G. 1 Prior Art
FIG. 1 is a schematic view of the prior art.
Figure 2:
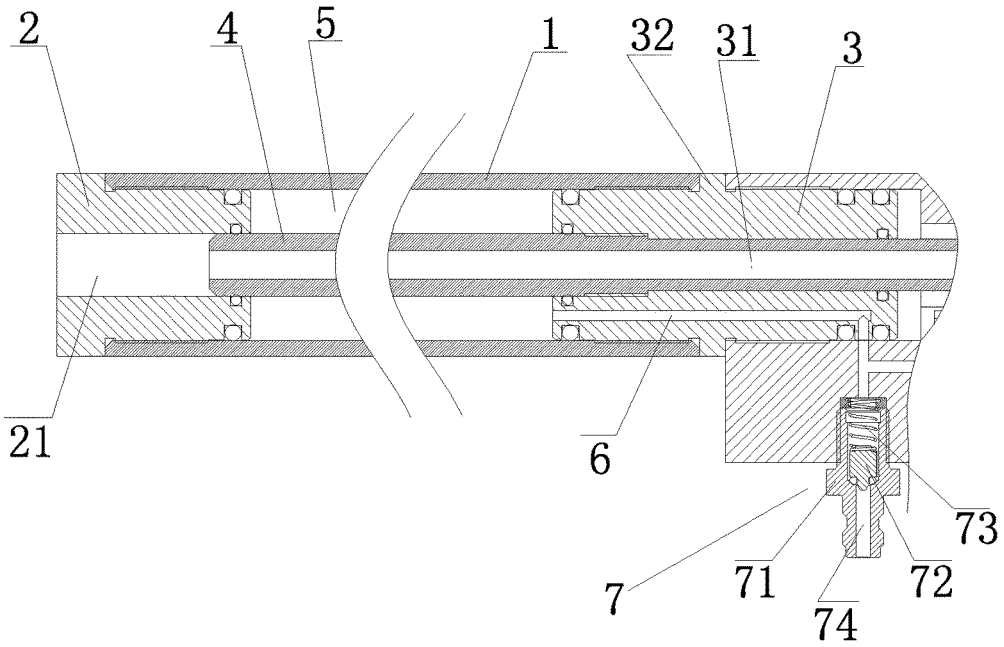
FIG. 2 is a schematic view of the present invention.

As shown in FIG. 2, the present invention discloses an integrated structure of a barrel and an air storage pipe of an air gun. The air storage pipe 1 is fixedly connected with a first connecting member 2 and a second connecting member 3. The barrel 4 is fixedly connected between the first connecting member 2 and the second connecting member 3. The air storage pipe 1, the first connecting member 2, the second connecting member 4 and the barrel 4 cooperate to form an air storage area 5. The air storage area 5 is located between the first connecting member 2 and the second connecting member 3 and communicated with an inflation head 7 through an air supply passage 6 disposed in the second connecting member 4.

The first connecting member 2 has a first chamber 21 therein. The second connecting member 3 has a second chamber 31 therein. The first connecting member 2 and the second connecting member 3 are threadedly connected to the air storage pipe 1. The barrel 4 is fixed in the first chamber 21 and the second chamber 31. The barrel 4 is threadedly connected with the first connecting member 2 and the second connecting member 3.

The first chamber 21 is in communication with the air outside the air gun, and the muzzle of the barrel 4 is located in the first chamber 21.

The first connecting member 2 has a T-shaped cross section. A portion of the first connecting member 2 is exposed to wrap the outer wall of the air storage pipe 1, so that the exposed portion of the first connecting member 2 has the same level as the air storage pipe 1 to enhance the connecting strength of the first connecting member 2 and the air storage pipe 1 and to protect the air storage pipe 1.

The second connecting member 3 is provided with a projection 32 on a surface in contact with the air storage pipe 1 to form a step to strengthen the connecting strength of the second connecting member 3 and the air storage pipe 1.

Sealing rings 8 are provided at the junction of the barrel 4 and the first connecting member 2, the junction of the barrel 4 and the second connecting member 3, the junction of the first connecting member 2 and the air storage pipe 1, and the junction of the second connecting member 3 and the air storage pipe 1, respectively.

The inflation head 7 includes an inflation seat 71 fixed to the air gun. A sealing head 72 is movably disposed in the inflation seat 71. One end of the sealing head 72 is connected with a spring 73. The sealing head 72 is biased by the spring 73 to seal an inflation inlet 74.

For air inflation, an inflation bottle is connected with the inflation seat 71 to open the sealing head 72, so that the air supply passes through the air supply passage to enter the air storage area 5 to realize air storage.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An integrated structure of a barrel and an air storage pipe of an air gun, the air storage pipe being fixedly connected with a first connecting member and a second connecting member, the barrel being fixedly connected between the first connecting member and the second connecting member; the air storage pipe, the first connecting member, the second connecting member and the barrel cooperating to form an air storage area, the air storage area being located between the first connecting member and the second connecting member and communicated with an inflation head through an air supply passage disposed in the second connecting member, wherein the inflation head has an inflation seat fixed to the air gun, a sealing head is movably disposed in the inflation seat, one end of the sealing head is connected with a spring, and the sealing head is biased by the spring to seal an inflation inlet.

2. The integrated structure of the barrel and the air storage pipe of the air gun as claimed in claim 1, wherein the first connecting member has a first chamber therein, the second connecting member has a second chamber therein, the first connecting member and the second connecting member are threadedly connected to the air storage pipe; the barrel is fixed in the first chamber and the second chamber, the barrel is threadedly connected with the first connecting member and the second connecting member; the first chamber is in communication with air, and a muzzle of the barrel is located in the first chamber.

3. The integrated structure of the barrel and the air storage pipe of the air gun as claimed in claim 2, wherein sealing rings are provided at the junction of the barrel and the first connecting member, the junction of the barrel and the second connecting member, the junction of the first connecting member and the air storage pipe, and the junction of the second connecting member and the air storage pipe, respectively.

* * * * *